US006073574A

United States Patent [19]

King et al.

[11] Patent Number: 6,073,574

[45] Date of Patent: Jun. 13, 2000

[54] KAYAK HATCH COVER RETENTION SYSTEM

[76] Inventors: Todd Dean King, 601 Cleveland St., #10C; Thomas M. Dempsey, 303 Dunham Bridge Rd., both of Greenville, S.C. 29601

[21] Appl. No.: 09/181,259

[22] Filed: Oct. 28, 1998

[51] Int. Cl.[7] ..... B63B 17/00

[52] U.S. Cl. ..... 114/364; 114/201 R; 114/202; 114/347; 49/463; 220/315

[58] Field of Search ..... 114/120, 178, 114/201 R, 202, 203, 347, 364; 49/463, 466; 220/315, 326, 348, 351

[56] References Cited

U.S. PATENT DOCUMENTS

| | | | |
|---|---|---|---|
| 3,834,340 | 9/1974 | Thorpe | 114/201 R |
| 4,570,816 | 2/1986 | Ferris et al. | 220/314 |
| 4,986,438 | 1/1991 | Borst | 220/315 |

*Primary Examiner*—Jesus D. Sotelo
*Assistant Examiner*—Ajay Vasudeva
*Attorney, Agent, or Firm*—Cort Flint

[57] ABSTRACT

A hatch cover for covering a hatch of a water craft is disclosed. The hatch includes a hatch rim surrounding the periphery of the hatch and the hatch cover comprises a peripheral skirt having a latch interfitting with said hatch rim when the hatch cover is fitted upon the hatch in a closed position. A biasing connector assembly retains and secures the hatch cover on the water craft in the closed position, and when the hatch cover is removed from the closed position. The connector assembly has a first configuration for biasing and retaining the hatch cover in the closed position on the hatch. The connector assembly has a second configuration when the hatch cover is removed in the open position in which the hatch cover remains connected to the water craft. A gasket may be interfitted between the periphery of the hatch rim and the periphery of the hatch cover skirt to seal against the entry of water. The biasing connector assembly includes first and second biasing elements symmetrically affixed to opposing sides of the hatch cover. Each biasing element has a first end affixed to the hatch cover and a second end attached to the kayak. A cover handle allows the boater to easily and reliably remove and install the hatch cover with a single hand due to the symmetry.

26 Claims, 4 Drawing Sheets

KAYAK HATCH COVER RETENTION SYSTEM

BACKGROUND OF THE INVENTION

This invention relates to kayaks and other water craft wherein internal storage compartments are provided with a hatch having a hatch cover which must be retained to provide a watertight compartment. In particular, the invention relates to a hatch cover and retention system which prevents the loss of the hatch cover when opening and closing the hatch.

The popularity of white water and other kayaking has grown tremendously over the past two decades. The use of kayaks and other similar types of water craft for touring lakes, rivers, and oceans, has become increasingly popular over the last ten years. These expanded uses of kayaks have necessitated the provision of storage compartments within the hull and a hatch for access. A hatch cover which covers the hatch is typically secured to the kayak by bungee cords or other straps. The cords or straps are criss-crossed or otherwise connected over the hatch cover and secured to the hatch. However, a problem occurs when the hatch cover is removed from the hatch. The removed cover is free and can be easily dropped by the boater. Any sudden movement, which is typical in a kayak, can cause the boater to lose the hatch cover. Handling of the free hatch cover when the hatch is opened is a tedious and difficult problem. If the hatch cover is lost, then stored articles are easily susceptible to water damage or loss. In the case of white water conditions, the problems are increased.

Accordingly, an object of the invention is to provide a hatch cover and retention system which prevents the loss of the hatch cover during opening and closing of a hatch in a water craft.

Another object of the present invention is to provide a hatch cover retention system which prevents the loss of the hatch cover while the kayak is being transported by a vehicle at high speeds.

Another object of the present invention is to provide a removable hatch cover for the hatch of a water craft which may be moved between open and closed positions in a quick and convenient manner while safely retaining on the kayak.

Still another important object of the invention is to provide a removable hatch cover which is secured to the hull of a kayak and may be easily and safely grasped by the kayaker for removal for access to the hatch while the hatch cover is retained on the kayak.

Yet another important object of the present invention is to provide a hatch cover elastically retained on a hatch of a kayak that may be easily grasped by the kayaker and moved against a biasing force for removal of the hatch cover while the hatch cover is securely retained in a closed position by the biasing force.

The hatch cover attachment system of the present invention reduces the number of attachment points and number of holes drilled into the kayak thereby reducing the chance of water entering the hull.

SUMMARY OF THE INVENTION

The above objectives are accomplished according to the present invention by providing a hatch cover retention system for a kayak having at least one hatch which provides access to a storage area within the hull of the kayak. The system includes a hatch having an outer peripheral rim, and a hatch cover for covering the hatch having a peripheral skirt which mates with the hatch rim. A biasing connector assembly secures the hatch cover to the hatch in a closed position. The connector assembly connects the hatch cover to the kayak when removed from the hatch in an open position. The biasing connector assembly has a first configuration for biasing the hatch cover in a first direction to retain the skirt of the hatch cover in mating relationship with the hatch rim whereby the hatch cover is retained. The biasing connector assembly is movable to a second configuration wherein the hatch cover is moved in a second direction opposite to the first direction for removal of the hatch cover from the hatch yet the hatch cover remains attached by the connector assembly. The skirt of the hatch cover includes a skirt wall depending generally down from a top surface of the cover. A skirt lip extends inward towards the hatch for interfitting with the hatch rim. The skirt lip extends only partially about the skirt wall and blends into the skirt wall at a transition area to become generally uniform with a remainder of the periphery of the skirt wall. This allows the lip to act as a latch for retention and removal. Preferably, the cover includes a handle, and the skirt lip is formed symmetrically about the handle.

Advantageously, the hatch rim includes an upper outwardly extending rim flange defined by a lower inwardly extending rim recess. The skirt lip fits underneath the rim flange within the rim recess when the hatch cover is in the closed position. Preferably, the biasing connector assembly includes first and second biasing elements carried generally symmetrically about the hatch cover for applying a balanced biasing force urging the lip under the rim flange in the closed position. This expedient also allows a uniform pull by the boater to unlatch and remove the hatch cover. A cleat is carried by the kayak, and the elastic elements or ends have a first end secured to the hatch cover and a second end secured to the cleat. The peripheral skirt of the hatch cover comprises at least one lateral wall tab, and the first end of the elastic cords are connected to the lateral tabs and to the kayak on a second end. Preferably, the lateral wall tab includes an opening and the elastic cord is knotted in the opening and secured within the cover. A gasket may be interfitted between the periphery of the hatch rim and the hatch cover skirt to seal against the entry of water. Advantageously, the gasket comprises an elastic sealing cover fitted over the hatch rim and between the hatch rim and hatch cover.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
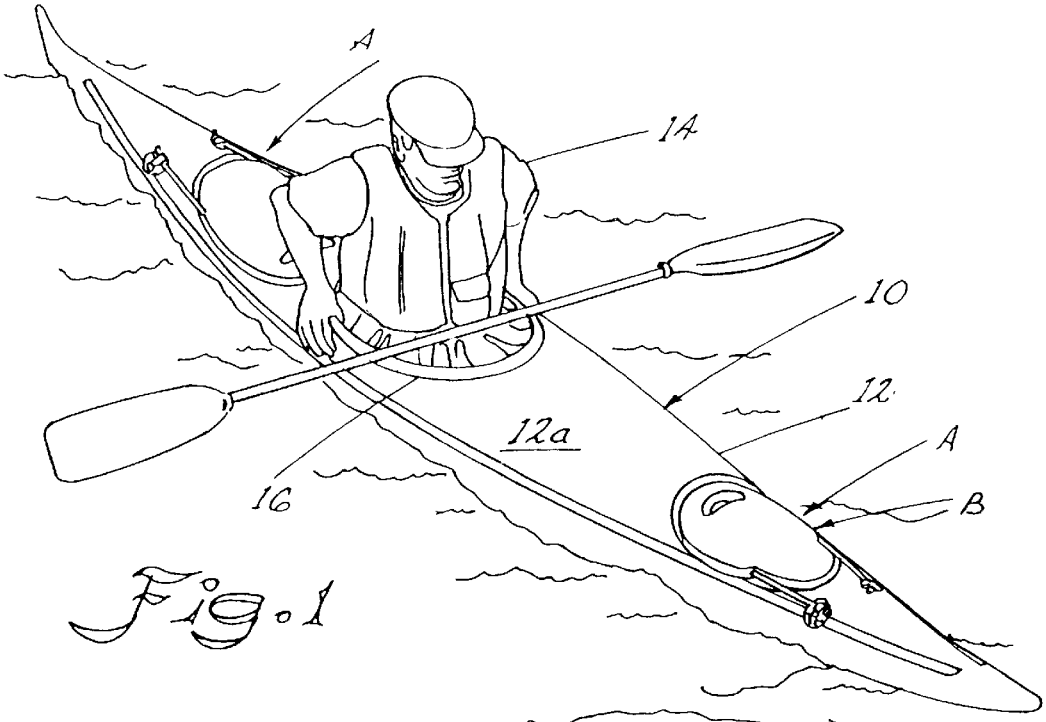
FIG. 1 is a perspective view of a touring kayak having retained hatch cover system according to the invention.
Figure 2:
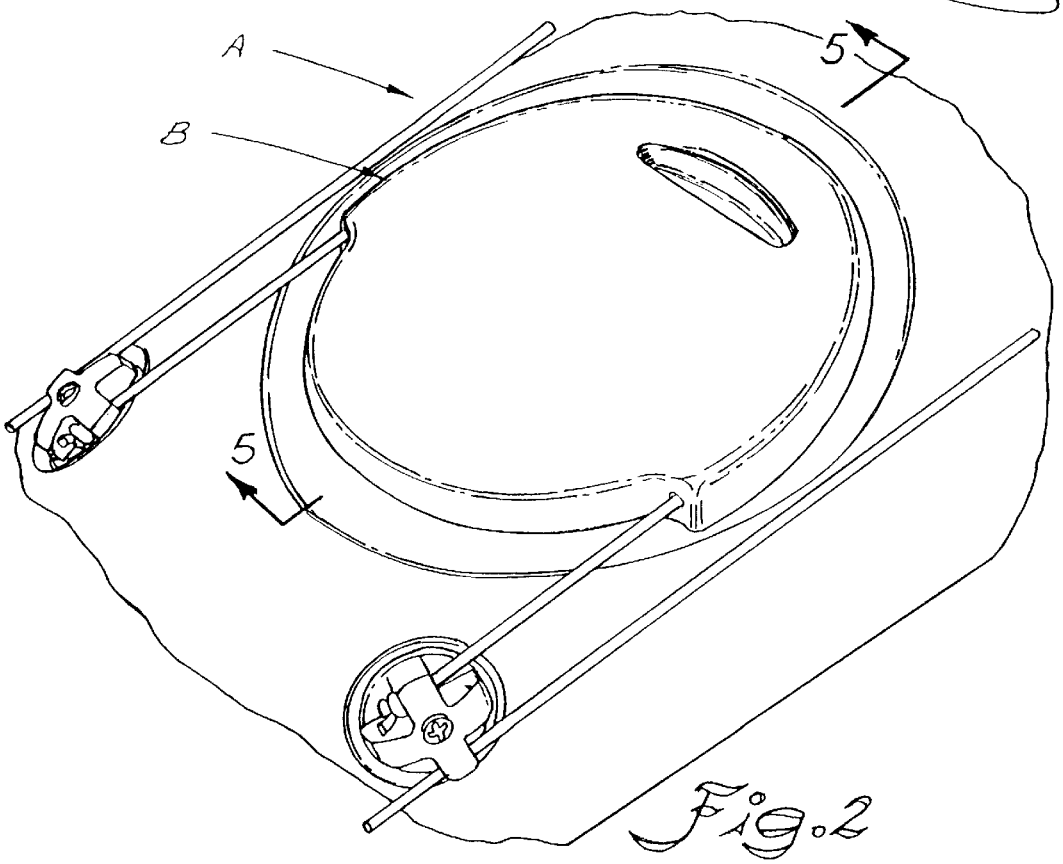
FIG. 2 is an enlarge perspective view of a retained hatch cover system according to the present invention.

Referring now to the drawings, the invention will now be described in more detail.

FIG. 1 illustrates the water craft in the form of a kayak 10 having a bow and a stern hatch cover assembly, designated generally as A, which cover hatches 20 leading into storage compartments formed within the kayak 10. The hatches are formed in an upper deck 12*a* of kayak hull 12. Boater 14 is seated in a cockpit 16 of the kayak in a conventional manner.

Hatch 20 includes a rim 22 around the perimeter of the hatch opening. Rim 22 includes an outwardly extending flange 24 defined by a inward recess 26. Typically the kayak hull 10, cockpit seat 16, and the bow and stern hatch 20 are formed as one piece. The kayak may be molded by using rotational molding as disclosed in U.S. Pat. Nos. 4,247,279 and 5,039,297, or may be formed by fiberglass or other molding and forming techniques. The storage area underneath the hatch may be open to the remainder of the kayak, or may be entirely closed within the hull. Since the exact configuration of the storage area beneath the hatch forms no part of the invention, only those details of a kayak necessary to an understanding of the invention will be described.

Figure 4:
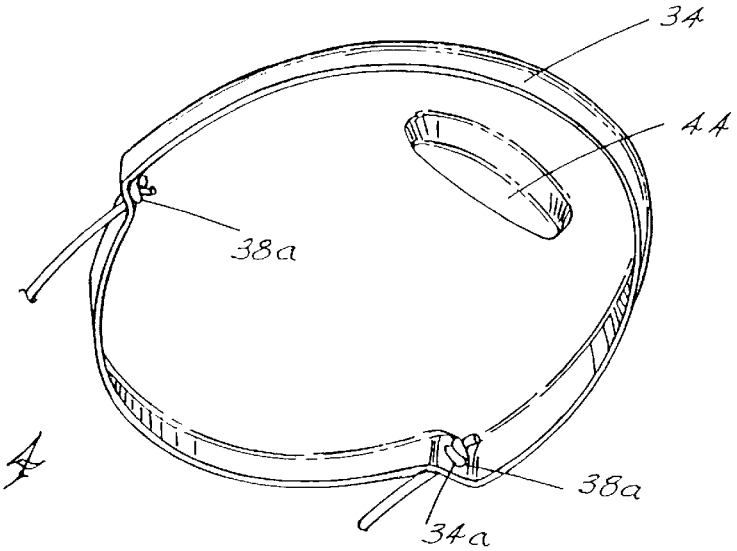
FIG. 4 is a bottom perspective view of the hatch cover of FIG. 3.

Referring now in more detail to hatch cover retention system A of the present invention, there is a hatch cover, designated generally as B, which covers hatch 20. Hatch cover B includes a peripheral skirt 30 which turns down from the generally planer top surface 32 of the cover and encloses the perimeter of the hatch cover. Skirt 30 includes a skirt wall 34 that depends downwardly from the top surface and surrounds the peripheral. The skirt wall 34 includes a generally laterally extending skirt tab 34*a* which extends laterally inwardly on each side thereof, and terminates in a reduced skirt wall 34*b*. The lateral skirt tabs 34*a* include an opening 34*d* for connection to a biased connector assembly, designated generally 36, in accordance with the invention. The biasing connector assembly 36 includes a biasing element 38 which may be an elastic cord such as a "bungee cord" or any other suitable biasing member. One end of bungee cord 38 is knotted at 38*a* inside the hatch cover (FIG. 4) and the opposing end of the bungee cord is attached through an arm 40*a* of a star cleat 40 affixed in a recess 40*b* of the kayak hull. Alternately a one piece bungee cord may be used that extends continuously through the arms 40*a* of the star cleat in lieu of being knotted at the star cleat. Other arms of the star cleat are used to secure cording for other parts of the kayak. A similar biasing connector assembly 36 is connected between the kayak hull and the hatch cover on the opposing side of the kayak. At least one biasing member need be connected between the hatch cover and kayak, preferably two are used, as illustrated, for symmetry and ease of operation.

Figure 5:
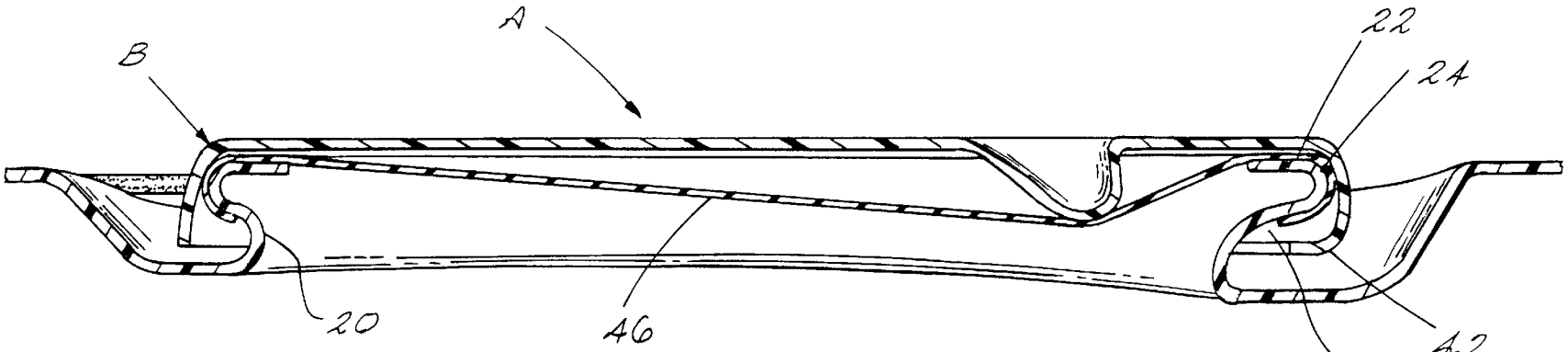
FIG. 5 is a sectional view taken along line 5—5.
Figure 6:
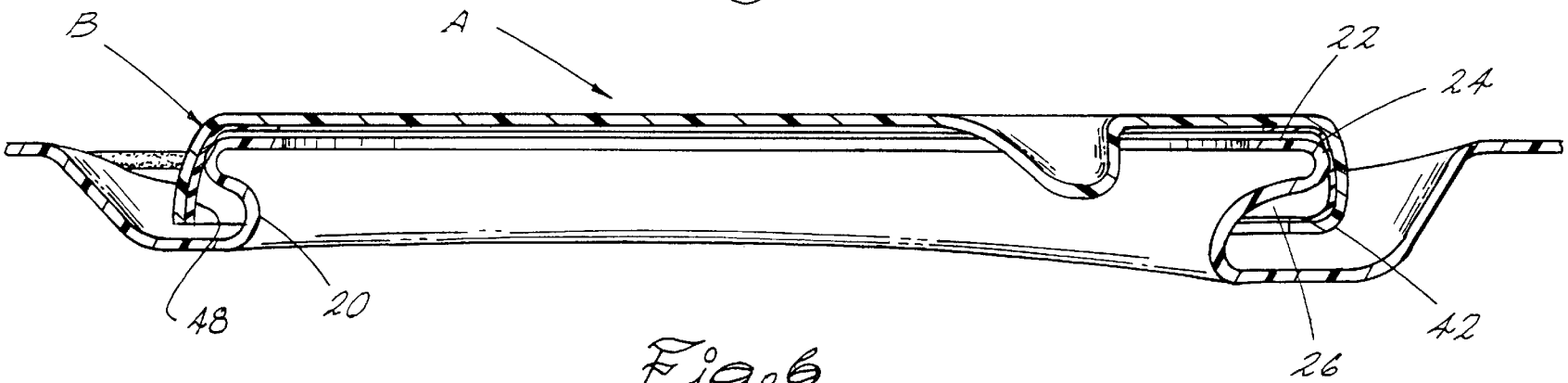
FIG. 6 is an alternate body of a hatch cover assembly according to the invention taken along the same cross-section as FIG. 5
Figure 7:
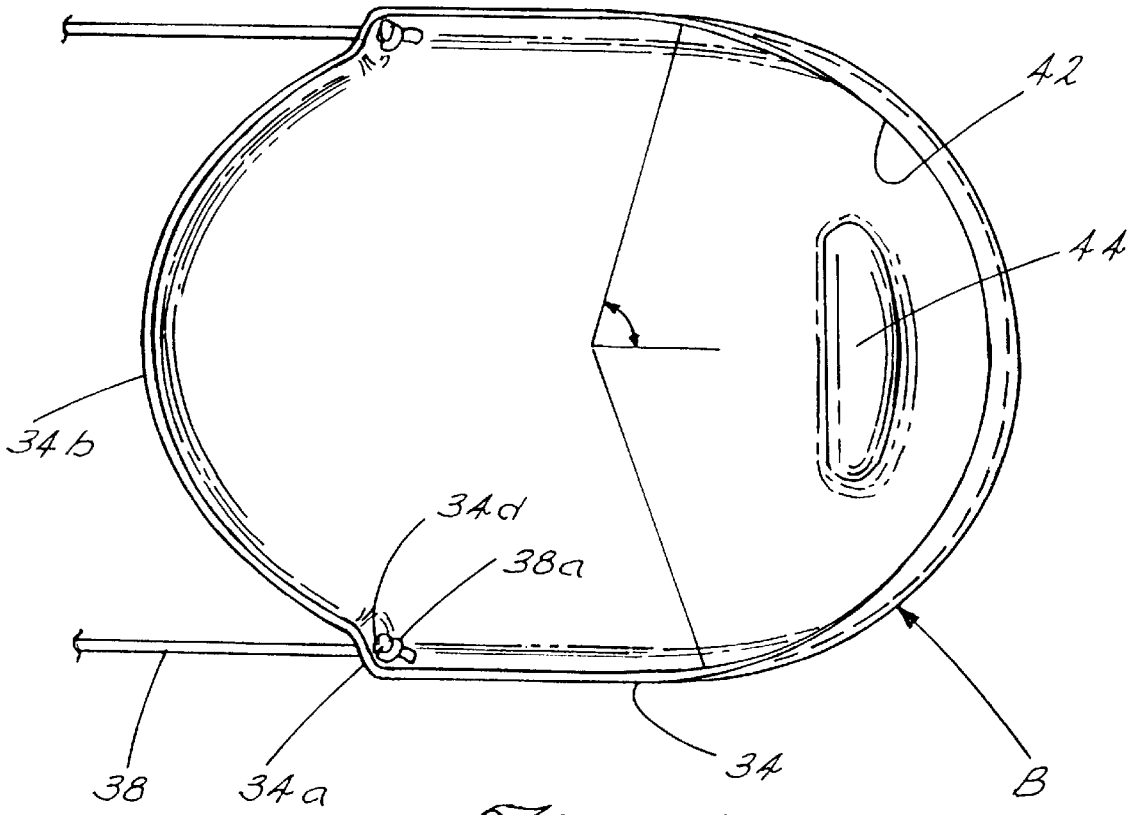
FIG. 7 is a bottom plan view of the hatch cover of the present invention.

As can best be seen in FIGS. 5–7, skirt 34 of hatch cover B includes a inwardly extending lip 42 which extends peripherally for about a 70° angle symmetrically with respect to a handle 44 of the hatch cover. Lip 42 blends back into the skirt of the hatch cover and becomes down turned generally at 90° to top surface 32 after it flares back into the skirt wall 34 as indicated (FIG. 7) Lip 42 fits in recess 26 underneath flange 24, and is secured in that position by biasing system 36. FIG. 5, a neoprene cover seal 46 is illustrated which elastically fits over the hatch underneath the hatch cover for additional waterproofness. Alternately, in situations where the hatch need not be completely waterproof, an optional sealing gasket 48 may be utilized to seal just around the edges of hatch rim 22 (FIG. 6).

Figure 3:
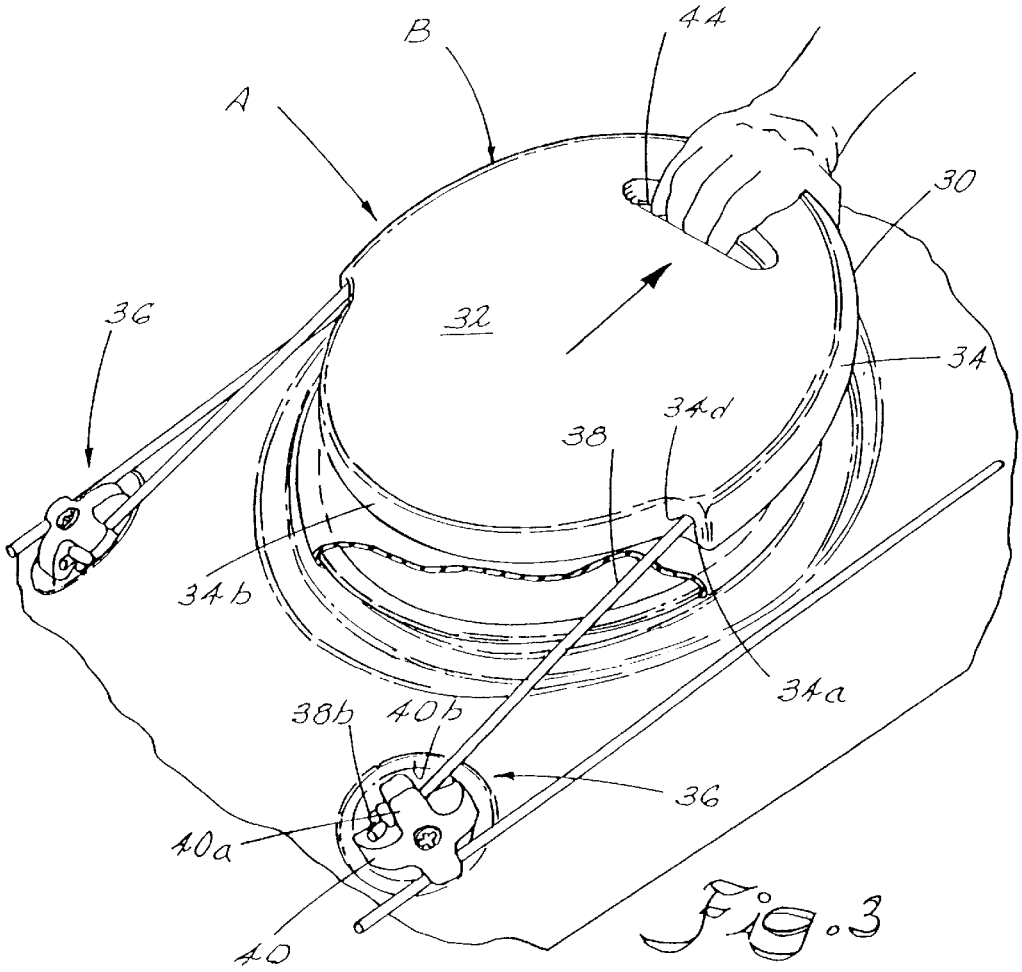
FIG. 3 is a similar perspective view of a retained hatch cover system according to the invention with the hatch cover being pulled by the boater in a second direction for removal from the hatch.

In use, lip 42 fits underneath flange 24 of hatch rim 22 and is disposed within recess 26. This latches the forward end of the hatch securely underneath the hatch rim. The biasing elements, e.g., bungee cords 38, pull the hatch cover in a first direction which urges lip 42 of the cover tightly underneath flange 24 of the hatch rim. This secures the hatch cover in a retained position. The remainder of hatch cover B is secured around the periphery of the hatch rim 22 by skirt 34. It will be noted that the top surface of the hatch cover 32 in junction of skirt 34 essentially conform to the shape of hatch rim 22 except in the areas of lateral walls 34*a* where the skirt departs slightly. Accordingly, there will be a tight fit between the hatch cover and rim in a closed, retained position previously described. When opening of the hatch is needed, the kayaker grasps handle 44 with his hand (FIG. 3) and pulls hatch cover B towards himself. The kayaker pulls hatch cover B in a second direction (arrow indicated) opposite to the first direction in which the hatch cover is tensioned onto the hatch. This second opposite direction elongates the biasing connector elements and allows lip 42 to be dislodged from underneath flange 24 of the hatch rim to unlatch the hatch cover for removal. With the hatch cover completely removed from the hatch, it can be seen that the hatch cover still remains secured by bungee cords 38 connected to star cleats 40 on both sides of the hatch. The hatch cover cannot be lost and may easily be grasped again by the boater to place the hatch cover in a closed, retained position previously described. The hatch is easily opened and closed and the symmetrical and elastic retention of the hatch cover provides for easy and convenient placement and removal of the hatch cover. The hatch cover is tensioned in a secure position with lip 42 underneath flange 24 so that it cannot be accidentally removed even in vigorous white water conditions or when being transported by vehicle. The invention has been described as a retention system for a hatch cover, it is to be understood, of course, that the invention may have application to other types of water craft and situations where it is needed to place and remove a cover without loss of the cover in difficult conditions such as kayaking.

While a preferred embodiment of the invention has been described using specific terms, such description is for illustrative purposes only, and it is to be understood that changes and variations may be made without departing from the spirit or scope of the following claims.

What is claimed is:

1. A hatch cover retention system for a kayak having at least one hatch which provides access to a storage area within the hull of the kayak comprising:

a hatch having an outer peripheral rim;

a hatch cover for covering said hatch;

said hatch cover including a peripheral skirt which mates with said hatch rim;

a biasing connector assembly for securing said hatch cover to said hatch in a closed position; and said connector assembly connecting said hatch cover to said kayak when removed from said hatch in an open position;

said biasing connector assembly having a first configuration for biasing said hatch cover in a first direction to retain said skirt of said hatch cover in mating relationship with said hatch rim whereby said hatch cover is retained, and said biasing connector assembly movable to a second configuration wherein said hatch cover is moved in a second direction opposite to said first direction for removal of said hatch cover from said hatch.

2. The system of claim 1 wherein said skirt of said hatch cover includes a skirt wall depending generally down from a top surface of said cover, and a skirt lip which extends inward towards said hatch for interfitting with said hatch rim.

3. The system of claim 2 wherein said skirt lip extends only partially about said skirt wall and blends into said skirt wall at a transition area to become generally uniform with a remainder of the periphery of said skirt wall.

4. The system of claim 3 wherein said skirt lip extends symmetrically from about 30° to 90° around the periphery of said skirt.

5. The system of claim 4 wherein said cover includes a handle, and said skirt lip is formed symmetrically about said handle.

6. The system of claim 2 wherein said hatch rim includes an upper outwardly extending rim flange defined by a lower inwardly extending rim recess, said skirt lip fits underneath said rim flange within said rim recess when said hatch cover is in said closed position.

7. The system of claim 6 wherein said biasing connector assembly includes first and second biasing elements carried generally symmetrically about said hatch cover for applying a balanced biasing force urging said lip under said rim flange in said closed position and allowing a uniform pull by a boater to unlatch and remove said hatch cover.

8. The system of claim 7 including a cleat carried by said kayak, and said biasing elements having a first end secured to said hatch cover, and a second end secured to said cleat.

9. The system of claim 7 wherein said biasing elements comprise elastic cords.

10. The system of claim 1 wherein said hatch rim includes an upper outwardly extending rim flange defined by a lower inwardly extending rim recess below said rim flange, and said hatch cover includes a downwardly extending peripheral skirt which interfits with said rim flange of said hatch rim.

11. The system of claim 10 including a gasket interfitted between the periphery of said hatch rim and said hatch cover skirt to seal against the entry of water.

12. The system of claim 11 wherein said gasket comprises an elastic sealing cover fitted over the hatch rim and between said hatch rim and hatch cover.

13. The system of claim 1 wherein said hatch cover includes a recessed handle formed in a top surface of said hatch cover.

14. The system of claim 1 wherein said peripheral skirt of said hatch cover comprises at least one lateral wall tab, and said biasing connector assembly being connected to said lateral tab on a first end and being connected to said kayak on a second end.

15. The system of claim 14 wherein said lateral wall tab includes an opening and said biasing connector assembly comprises an elastic cord received in said opening and secured within said cover.

16. The system of claim 1 wherein said second direction is toward a boater seated in a cockpit seat of said kayak.

17. A hatch cover retention system for a kayak having at least one hatch which provides access to a storage area within the hull of the kayak comprising:

a hatch having an outer peripheral rim;

a hatch cover for covering said hatch;

said hatch cover including a peripheral skirt which mates with said hatch rim in a closed position;

a biasing connector assembly for securing said hatch cover to said hatch rim to close said hatch; and said biasing connector assembly connecting said hatch cover to said kayak when said hatch cover is removed from said hatch to prevent the loss of said hatch cover in an open position when said hatch is open.

18. The system of claim 17 wherein said skirt of said hatch cover includes a skirt wall depending generally down from a top surface of said cover, and a skirt lip which extends inward towards said hatch for interfitting with said hatch rim.

19. The system of claim 18 wherein said hatch rim includes an upper outwardly extending rim flange defined by a lower inwardly extending rim recess, said skirt lip fits underneath said rim flange within said rim recess when said hatch cover is in said closed position.

20. The system of claim 19 wherein said biasing connector assembly includes first and second biasing elements carried generally symmetrically about said hatch cover for applying a balanced biasing force urging said lip under said rim flange in said closed configuration and allowing a uniform pull by said boater to unlatch and remove said hatch cover.

21. A hatch cover for covering a hatch of a water craft, said hatch being of the type which includes a hatch rim surrounding the periphery of the hatch, said hatch cover comprising:

a top surface;

a peripheral skirt depending downwardly from said top surface of said hatch cover;

said hatch cover including a latch for interfitting with said hatch rim of said hatch when said hatch cover is fitted upon said hatch in a closed position;

a biasing connector assembly for retaining and securing said hatch cover on said water craft in said closed position and when the hatch cover is removed from said closed position; and said biasing connector assembly having a first configuration for biasing and retaining said hatch cover in said closed position on said hatch; and said connector assembly having a second configuration when said hatch cover is removed from said hatch in the open position in which said hatch cover remains connected to said water craft.

22. The system of claim 21 wherein said hatch rim includes an upper outwardly extending rim flange defined by a lower inwardly extending rim recess below said rim flange, said hatch cover includes a downwardly extending peripheral skirt which interfits with said rim flange of said hatch rim, and said latch being carried by said skirt.

23. The system of claim 22 including a gasket interfitted between the periphery of said hatch rim and the periphery of said hatch cover skirt to seal against the entry of water.

24. The system of claim 22 wherein said skirt of said hatch cover includes a skirt wall depending generally down from a top surface of said cover, and a skirt lip which extends inward towards said hatch which constitutes said latch for interfitting with said rim flange and rim recess.

25. The system of claim 24 wherein said skirt lip extends only partially about said skirt wall wherein said skirt wall becomes generally uniform without said lip about the remainder of the periphery of said skirt wall.

26. The system of claim 22 wherein said biasing assembly includes first and second biasing elements affixed to opposing sides of said hatch cover, each said biasing element having a first end affixed to said hatch cover and a second end attached to said kayak. remove and install the hatch cover with a single hand due to the symmetry.

* * * * *